US005943837A

United States Patent [19]

Esser et al.

[11] Patent Number: 5,943,837

[45] Date of Patent: Aug. 31, 1999

[54] QUICK ERECT SHELTER APPARATUS

[75] Inventors: Richard A. Esser, Laurel; Paul W. Wells, Ellicott City; Jerry L. Griffith, La Plata, all of Md.; Hunter L. Graves, Sterling, Va.

[73] Assignee: TVI Corporation, Glenn Dale, Md.

[21] Appl. No.: 08/790,621

[22] Filed: Jan. 29, 1997

Related U.S. Application Data

[60] Provisional application No. 60/010,846, Jan. 30, 1996.

[51] Int. Cl.[6] ..... E04H 12/18

[52] U.S. Cl. ..... 52/646; 52/63; 52/656.1; 135/133; 135/135; 135/123; 135/147; 403/170; 403/218

[58] Field of Search ..... 52/63, 81.1, 81.2, 52/81.3, 646, 653.1, 653.2, 655.1, 656.9; 135/123, 130, 131, 133, 135, 145, 147, 159, 907; 403/169, 170, 217, 218, 219

[56] References Cited

U.S. PATENT DOCUMENTS

| | | | |
|---|---|---|---|
| 3,140,563 | 7/1964 | Allen | 52/63 X |
| 3,810,482 | 5/1974 | Beavers . | |
| 4,156,433 | 5/1979 | Beaulieu | 135/145 |
| 4,450,851 | 5/1984 | Beavers . | |
| 4,637,748 | 1/1987 | Beavers . | |
| 4,829,735 | 5/1989 | Zwissler | 52/646 |
| 4,942,686 | 7/1990 | Kemeny | 52/646 X |
| 4,995,212 | 2/1991 | Morgan et al. | 52/646 |
| 5,144,784 | 9/1992 | Marti | 52/646 |
| 5,230,196 | 7/1993 | Zeigler . | |
| 5,274,980 | 1/1994 | Zeigler . | |
| 5,328,286 | 7/1994 | Lee | 135/135 X |

OTHER PUBLICATIONS

Mobifle Shelter Command Post Manual, Special Item No. F5038, Mfg. Item No. 92500, MS 2.5, 1990.

Pop 'N' Work Product Line Brochure distributed by FOF Product Incorp., 1994.

Free Standing Integral Frame Industrial Tents Brochure distributed by T.A. Pelsue Co., 1993.

*Primary Examiner*—Carl D. Friedman
*Assistant Examiner*—Kevin D. Wilkens
*Attorney, Agent, or Firm*—Finnegan, Henderson, Farabow, Garrett & Dunner, L.L.P.

[57] ABSTRACT

A quick erect shelter frame includes a plurality of one piece hubs. Each hub including a base portion having peripheral edges, an upper surface, a lower surface, and a center portion with a hole extending therethrough in a direction perpendicular to the upper surface. Each hub further including a plurality of spaced support members, each extending from the upper surface of the base portion substantially flush with a respective peripheral edge. Each support member having a top surface, a length less than the length of one peripheral edge of the base portion, a hole extending through a first end of the support member in a direction perpendicular to a face surface thereof, and a bore extending in a side of a second end of the support member in a direction perpendicular to the hole in the first end. The hole of each support member being axially aligned with the bore of an adjacent support member.

14 Claims, 12 Drawing Sheets

QUICK ERECT SHELTER APPARATUS

This application claims benefit of Provisional No. 60,010,846 filed Jan. 30, 1996.

BACKGROUND OF THE INVENTION

1. Field of the Invention

The present invention relates to quick erect shelters, and more particularly to frames including hubs and hub assemblies for quick erect shelters.

2. Description of the Related Art

A quick erect shelter, such as shown in FIG. 1, is a completely integrated, modular shelter system, which is rugged and flexible in design. The quick erect shelter 20 is designed for rapid setup as well as rapid breakdown. The shelter 20 includes an exterior canopy 22 and an interior liner 24 that are preattached to an articulate frame 26 which expands to an arched frame when erected. The shelter 20 is self-supporting, which eliminates the need for supplementary erection devices, such as push poles, and supplementary support devices, such as center poles.

The self-supporting nature of the shelter 20 is derived from its articulate frame 26. As shown in FIGS. 2(*a*) and (*b*), the articulate frame 26 consists of cylindrical aluminum tubes, referred to as struts 28, which are interconnected to hubs 30 by pivotal joints 32. Each hub 30, which may interconnect with as many as four struts 28, includes a hole 36 which enables the exterior canopy 22 and interior liner 24 to be attached to each hub 30, depending upon whether the hub 30 is located on the external or internal portion of the articulate frame 26, respectively. The hole 36 also enables a stabilizing rod 34 to be partially inserted into the hub 30 in order to provide additional support to the frame 26 and to maintain the symmetry of the frame 26. The stabilizing rod 34 consists of a solid aluminum cylindrical rod. The rod 34 is connected at a threaded end to the hole 36 of one hub 30, and is forcibly wedged at its opposing end into the hole 36 of an opposing hub 30.

A typical quick erect shelter is arranged such that the plurality of struts 28 and hubs 30 form a lattice framework. In the expanded configuration, as shown in FIGS. 1 and 2(*a*), the struts 28 are assembled to form an arch as the basic building block of each shelter 20. Shelters 20 can be manufactured to any desired length by connecting arched sections with additional struts 28.

Heretofore, quick erect shelters used a conventional hub as shown in FIGS. 3(*a*)–3(*c*). A conventional hub 30 consists generally of a two-piece assembly made up of a base 38 and a body 40. The base 38 is square-shaped, has a uniform thickness, and has a hole 36 extending through its center portion. The base 38 further includes an upper surface 42 and a bottom surface 44. The body 40, which is attached via screws to the upper surface 42 of the base 38, consists of a rectangular center portion 46 communicating with ends of arms 48 extended at right angles all in the same rotary direction, thus, forming rectangular cutout portions 45. In short, the body 40 is formed in the shape of a swastika of uniform thickness.

The rectangular center portion 46 has a hole 50, extending therethrough, which is axially aligned with the hole 36 of the base 38. A mounting means 52, e.g., a nut 51 and a bolt 52 (or alternatively, a bolt and a threaded insert, or other comparable connecting means), may be fed through the exterior canopy 22 or interior liner 24 of the shelter 20 (depending upon where the hub 30 is located) through the hole 36 of the base 38 and through the hole 50 of the center portion 46 in order to connect the hub 30 to the exterior canopy 22 or interior liner 24.

Each arm 48 of the body 40 includes a rectangular first portion 54 having a hole 58 extending therethrough in a direction perpendicular to a face 49 of the first portion 54. Each arm 48 further includes a rectangular second portion 56 having a bore 60 extending into a side thereof in a direction perpendicular to the hole 58 of the first portion 54. The bore 60 of the second portion 56 of each arm 48 is axially aligned with the hole 58 of the first portion 54 of an adjacent arm 48.

A strut 28 is pivotally connected between two adjacent arms 48 of the hub 30 by a pin 62. The pin 62 extends through the hole 58 of the first portion 54 of an arm 48, through an end portion of the strut 28 and into the bore 60 of the second portion 56 of an adjacent arm 48.

The typical shelter framework, hubs, and hub assemblies heretofore described are satisfactory for the purposes intended. However, for certain applications it is desirable to provide a quick erect shelter that has the strength and advantages of typical shelters but which are lighter in weight, easy to assemble, and whose frame is capable of including utility lines such as electric, gas, and water.

SUMMARY OF THE INVENTION

Accordingly, the present invention is directed to an improved quick erect shelter, that substantially eliminates one or more of the problems due to the limitations and disadvantages of the related art.

Additional objects and advantages of the invention will be set forth in part in the description which follows, and in part will be evident from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a quick erect shelter frame comprising a plurality of one piece hubs. Each hub including a base portion having peripheral edges, an upper surface, a lower surface, and a center with a hole extending therethrough in a direction perpendicular to the upper surface. Each hub further comprising a plurality of spaced support members, each extending from the upper surface of the base portion substantially flush with a respective peripheral edge. Each support member having a top surface, a length less than the length of one peripheral edge of the base portion, a hole extending through a first end of the support member in a direction perpendicular to a face surface thereof, and a bore extending in a side of a second end of the support member in a direction perpendicular to the hole in the first end. The hole of each support member being axially aligned with the bore of an adjacent support member.

In another aspect, the invention comprises a quick erect shelter frame comprising a plurality of one piece hubs. Each hub comprising a base portion having peripheral edges, an upper surface, a lower surface, and a center with a hole extending therethrough in a direction perpendicular to the upper surface. Each hub further comprising a support member extending from the upper surface of the base portion substantially flush with the peripheral edges of the base portion. The support member having a center portion communicating with ends of four arms extended at right angles all in the same rotary direction. The center portion having a top surface, a hole extending therethrough which communicates with the hole of the base portion, and a frustoconical recess formed in the top surface which is concentric with the hole extending through the center portion. Each arm forms an open rectangular cutout portion in the body member, and has a first portion which is flush with a respective peripheral edge and has a top surface and a hole extending therethrough in a direction perpendicular to a face thereof. Each arm further includes a second portion, communicating with the center portion, and having a side, a top surface, and a bore extending in the side thereof in a direction perpendicular to the hole of the first portion. The hole of each arm being axially aligned with the bore of an adjacent arm.

In still a further aspect, the invention comprises a quick erect shelter frame comprising: a plurality of one piece hubs, a plurality of struts pivotally mounted to respective hubs in a lattice formation, a cable extending around the plurality of hubs; and a rotatably mounted means fastened to each hub for guiding the cable.

BRIEF DESCRIPTION OF THE DRAWINGS

The accompanying drawings, which are incorporated in and constitute a part of the specification, illustrate presently the preferred embodiments of the invention and, together with the general description given above and the detailed description of the preferred embodiments given below, serve to explain the principles of the invention. Of the drawings:

FIG. 2(*b*) is a plan view of the conventional quick erect shelter frame shown in FIG. 2(*a*), showing how the struts are pivotally interconnected with a hub of the frame.

FIG. 3(*b*) is a plan view of the conventional hub shown in FIG. 3(*a*).

FIG. 3(*c*) is a side view of the conventional hub shown in FIG. 3(*a*).

FIG. 4(*b*) is a side view of the hub of the FIG. 4(*a*).

FIG. 4(*c*) is a plan view of the hub shown in FIG. 4(*d*).

FIG. 4(*d*) is an isometric view of a portion of the hub shown in FIG. 4(*a*) and further comprising brace portions.

FIG. 5(*b*) is a side view of the hub shown in FIG. 5(*a*).

FIG. 5(*c*) is a plan view of the hub shown in FIG. 5(*a*).

FIG. 6(*b*) is an isometric view of the hub of FIG. 6(*a*) showing the bottom surface of the hub.

FIG. 6(*c*) is a side view of the hub of shown in FIGS. 6(*a*) and (*b*).

FIG. 6(*d*) is a plan view of the hub shown in FIG. 6(*a*).

FIG. 6(*e*) is a sectional view taken along section line A—A of FIG. 6(*d*).

FIG. 7(*b*) is an isometric view of the bottom surface of the hub of FIG. 7(*a*).

FIG. 7(*c*) is a side view shown in FIG. 7(*a*).

FIG. 7(*d*) is a plan view of the hub of FIG. 7(*a*).

FIG. 7(*e*) is a sectional view of the hub taken along section line A—A of FIG. 7(*d*).

FIG. 8(*b*) is an enlarged view of the quick erect shelter frame and cable within the circle of FIG. 8(*a*) showing eyebolts connected to hubs, for receiving the cable.

FIG. 8(*c*) is an enlarged view of the quick erect shelter frame and cable shown in FIG. 8(*a*) showing pulleys connected to hubs, for receiving the cable.

FIG. 8(*d*) is an isometric view of the quick erect shelter hub shown FIG. 4(*a*) having a pulley, such as shown in FIGS. 8(*a*) and 8(*c*), for receiving the cable.

FIG. 8(*e*) is a side view of the hub and pulley combination of FIGS. 8(*a*) and 8(*d*) showing how the pulley interconnects with the hub.

FIG. 8(*f*) is a front view of the pulley shown in FIG. 8(*d*).

DESCRIPTION OF THE PREFERRED EMBODIMENTS

Figure 1:
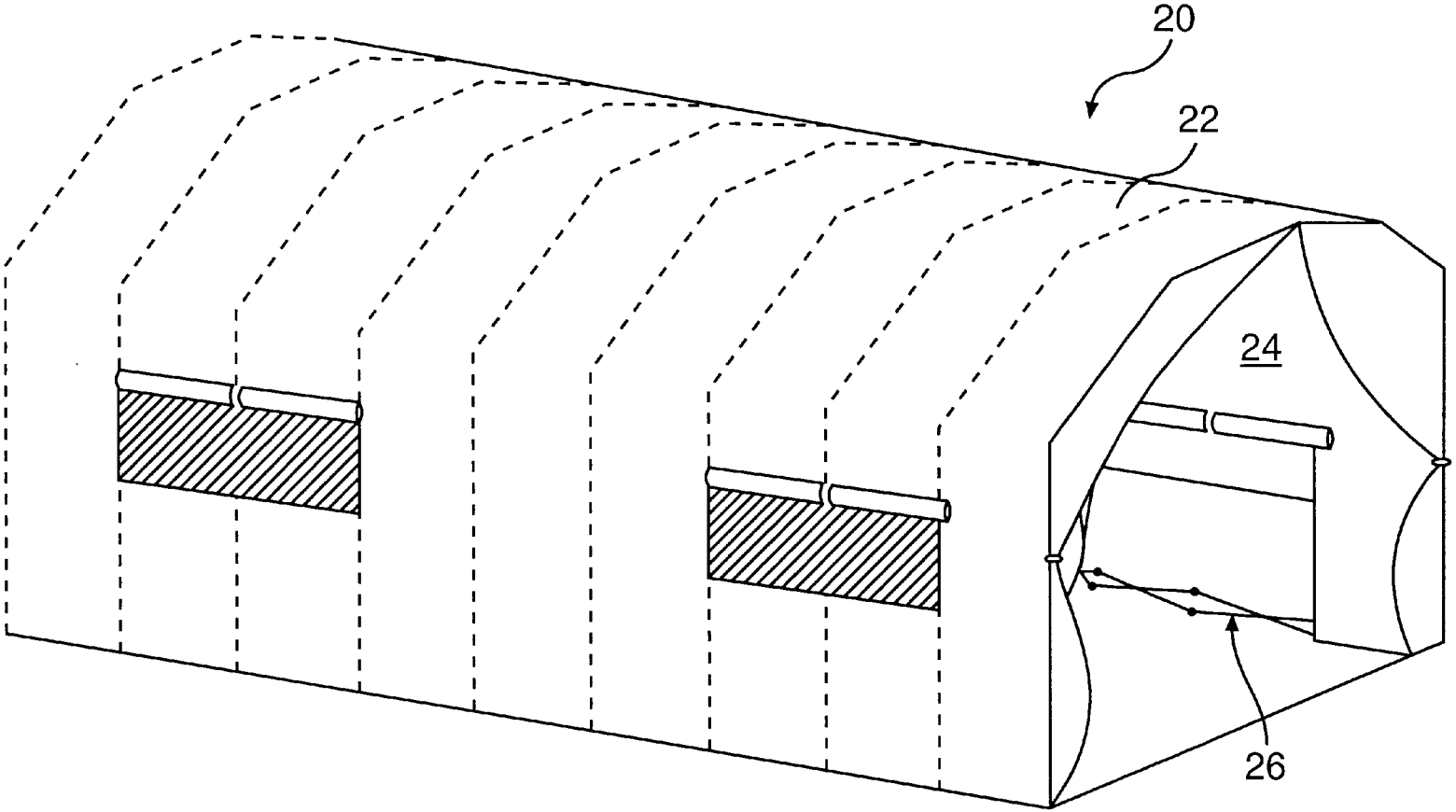
FIG. 1 (PRIOR ART)
FIG. 1 is an isometric view showing a conventional quick erect shelter including the exterior canopy, interior liner, and articulate frame.
Figure 2A:
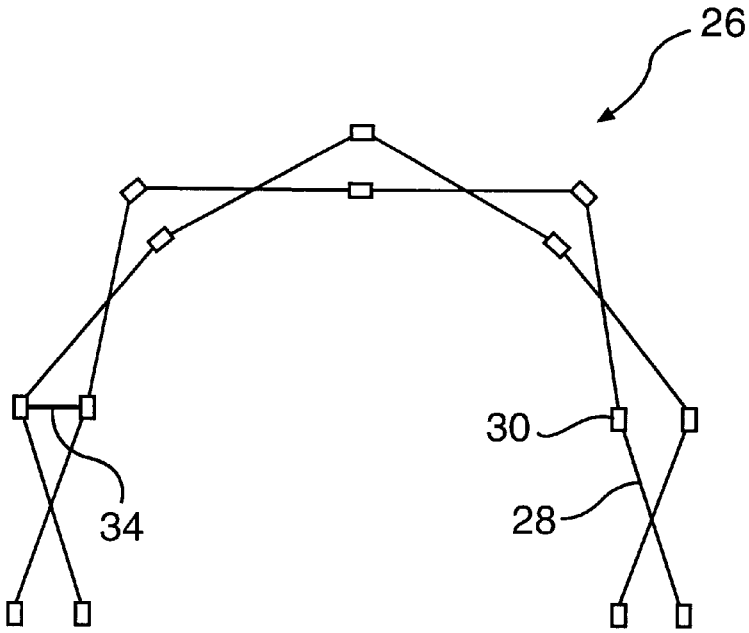
FIG. 2a (PRIOR ART)
FIG. 2(*a*) is a front view of the conventional quick erect shelter frame shown in FIG. 1, showing the interconnection of the hubs and struts of the frame.
Figure 2B:
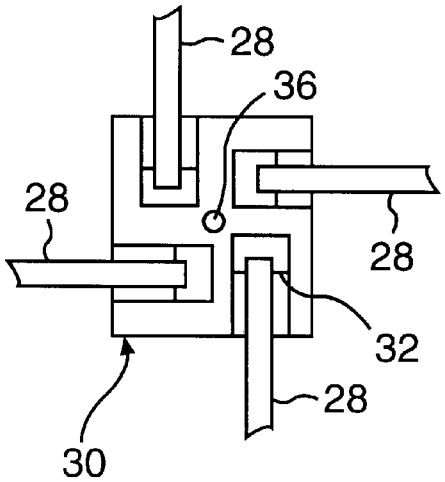
FIG. 2b (PRIOR ART)
Figure 3A:
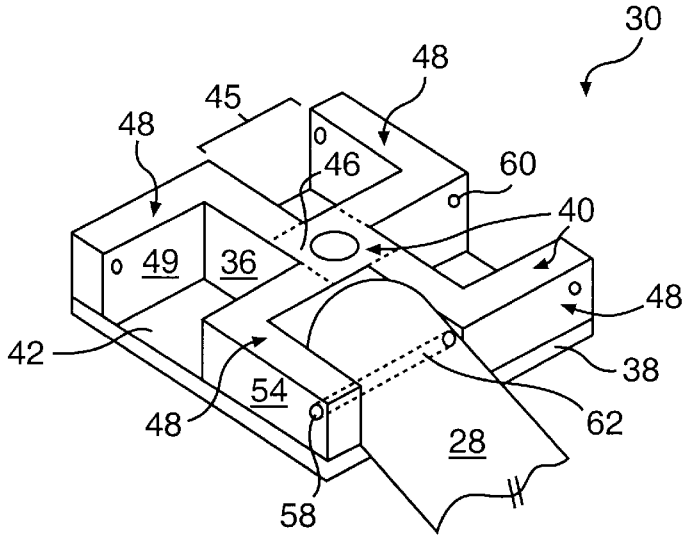
FIG. 3a (PRIOR ART)
FIG. 3(*a*) is an isometric view of a conventional hub of the quick erect shelter frame shown in FIG. 1.
Figure 3B:
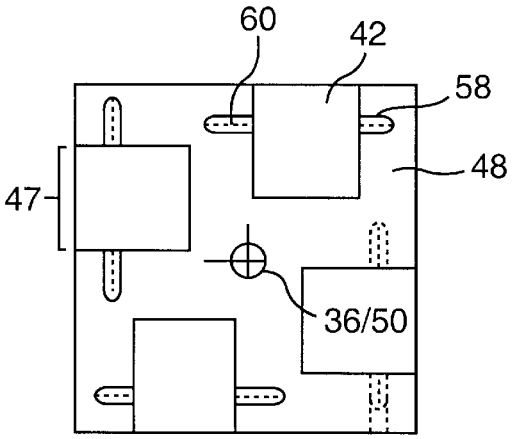
FIG. 3b (PRIOR ART)
Figure 3C:
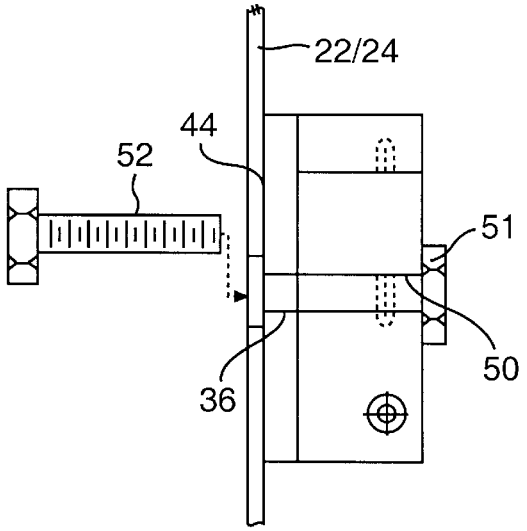
FIG. 3c (PRIOR ART)
Figure 4A:
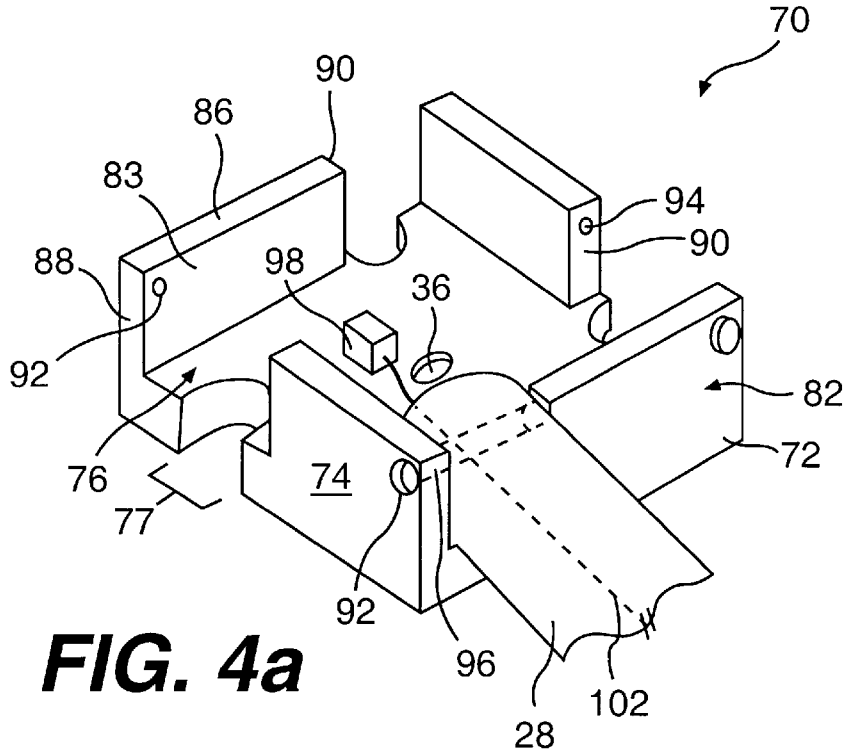
FIG. 4(*a*) is an isometric view of a quick erect shelter hub according to a first embodiment of the present invention.
Figure 4B:
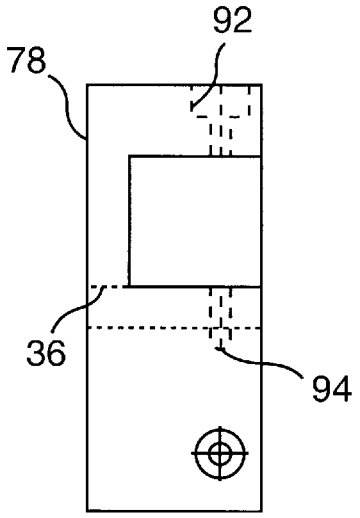
Figure 4C:
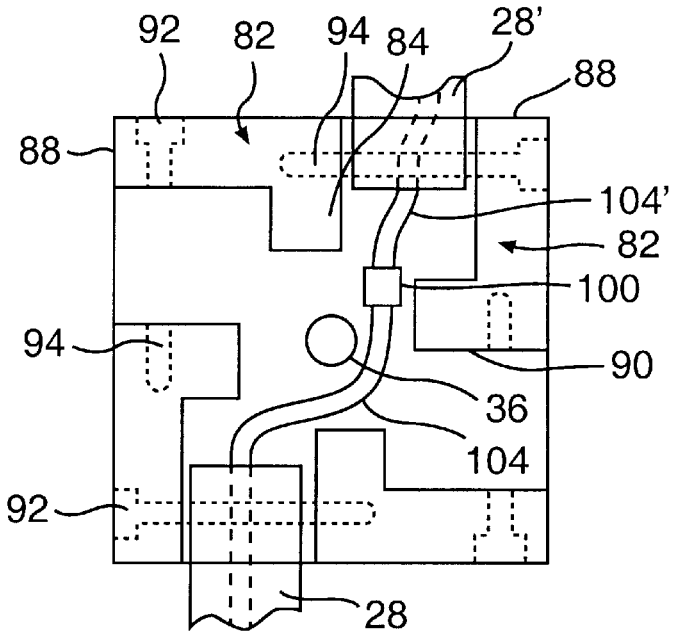
Figure 4D:
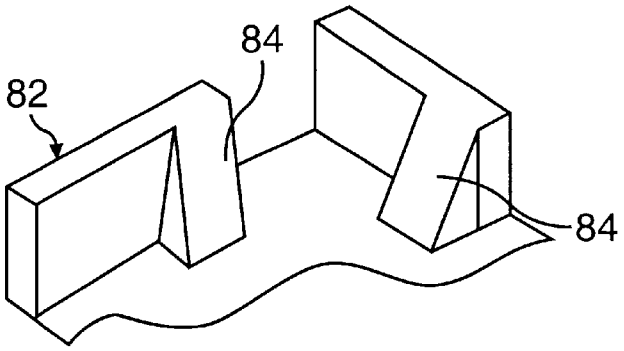

The present invention is generally drawn to quick erect shelters including frames, hubs, and hub assemblies of quick erect shelters.

Reference will now be made in detail to the present preferred embodiments of the invention, examples of which are illustrated in the accompanying drawings. Wherever possible, the same reference numbers will be used throughout the drawings to refer to the same or like parts.

The present invention comprises a quick erect shelter frame comprising a plurality of one piece hubs. Each hub including a base portion having peripheral edges, an upper surface, a lower surface, and a center with a hole extending between the upper and lower surfaces. A plurality of spaced support members extend from the upper surface of the base portion substantially flush with a respective peripheral edge. Each support member has a top surface, a length less than the length of one peripheral edge of the base portion, a hole extending through a first end of each support member, and a bore extending in a side of a second end of the support member in a direction perpendicular to the hole of the first end. The hole of each support member is axially aligned with the bore of an adjacent support member to pivotally support a strut.

As embodied herein and referring to FIGS. 4(*a*)–4(*c*), the hub 70 is formed of one piece, preferably by a molding process, but alternatively by a fabrication process or similar process. The hub 70 includes a base portion 72 having peripheral side edges 74, an upper surface 76, a lower surface 78, a center portion having a hole 36 extending therethrough. The base portion 72 is preferably rectangular in shape having four peripheral side edges. The hub 70 further includes spaced support members 82, each support member 82 extending from the upper surface 76 of the base portion 72, substantially flush with a respective peripheral edge 74 of the base portion 72. Each peripheral edge 74 of the base portion 72 further includes a groove 77 formed in the shape of a half circle.

Each support member 82 has a length which is less than a peripheral edge 74 of the base portion 72, a top surface 86, and first and second ends 88, 90. Each support member 82 also includes a hole 92 extending through its first end 88 in a direction perpendicular to a bore 94 formed in the second end 90 of the same support member 82. The hole 92 of each support member 82 is axially aligned with the bore 94 of an adjacent support member 82.

The hub 70 further includes screws or pins 96 (or other comparable connecting means), each screw or pin 96 extending through the hole 92 of one support member 82, through an end of the strut 28 and into the bore 94 of another support member 82 adjacent thereto to pivotally support one end of a strut. The hub is made to connect as many as four struts 28 to be pivotally connected by the screws or pins 96. However, for the sake of clarity, only one strut 28 is shown in FIG. 4(*a*) as being connected to the hub 70 by a screw or pin 96.

The struts 28 may support and provide a conduit for electrical lines 102 as shown in FIG. 4(*a*) where electrical lines 102 from one strut can be connected to an electrical line 102 of another strut within the hub 70. The electrical line 102 shown in FIG. 4(*a*) has at an end a plug 98 for connecting to another plug extending from the end of another strut (not shown) having an open end opposing the open end of strut 28. The plugs 98 are made large enough so that they will not pass beneath or atop the screw or pin 96 and become unreachable within the strut 28. With the hub 70 as shown in FIG. 4(*a*), one or more electrical plugs can be connected differently within the hub. Alternatively, the electrical line 102 can connect, via the plug 98, to another electrical line 102 extending from the end of a strut (not shown) having an open end adjacent to the open end of strut 28.

Furthermore, as shown in FIG. 4(*c*), an end of a water or gas line 104, having a connector 100, may extend from one end of a strut 28 through the hub between the top surface 86 of the support member 82 and the upper surface 76 of the base portion 72. The water or gas line 104 may then interconnect, via the connector 100, to another water or gas line 104' extending from the end of another strut 28' having an open end opposing the open end of strut 28. Alternatively, the water or gas line 104 can connect, via the connector 100, to another water or gas line (not shown) extending from the end of a strut (not shown) having an open end adjacent to the open end of strut 28.

For certain applications, such as a large structure that shelters hundreds of people, and is thereby subjected to great stress, the support members 82 may each include an internal brace portion 84. As shown in FIG. 4(*d*), each brace portion 84 extends inwardly towards the center of the base portion 72 from the top surface 86 of the support member 82 at an angle to provide a larger area of contact with the base portion 72. The brace portion 84 is preferably integral with each support member 82 or may be attached to each support member 82 with glue, screws, or other comparable connecting means.

The hub 70 has sufficient strength to support the framework of a shelter while its weight is significantly reduced. Also, the upper surface 76 of the base portion 72 of the hub 70 has an open center (due to the elimination of support members 82 at the center portion of the base portion 72) permitting the running of utility lines or pipes from one hub to the next through a connecting strut. The elimination of support members 82 at the center of the base portion 72 of the hub 70 also allows one to use shorter mounting means, i.e., bolts or screws, to connect the hub 70 to the external canopy or interior liner of the shelter. The shorter screws also reduce the overall weight of the quick erect shelter.

In this embodiment, the hub 70 may preferably have the following approximate dimensions. The base portion 72 may be a 2.25×2.25 inch square and have a thickness of 0.25 inches. The hole 36 formed in the base portion 72 may have a diameter of 0.25 inches. Each support member 82 may have a length of 1.125 inches, a height of 0.75 inches, and a thickness of 0.375 inches. Each groove 77 may have a diameter of 0.5 inches. The weight of the hub 70 is about 0.116 pounds, which is about 0.024 pounds lighter than the conventional hub 30.

Figure 5A:
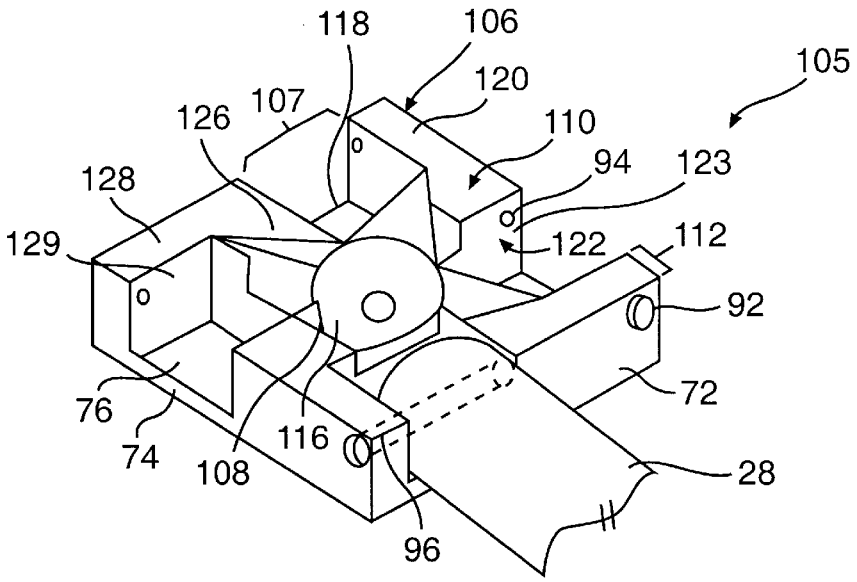
FIG. 5(*a*) is an isometric view of a quick erect shelter hub according to a second embodiment of the present invention.
Figure 5B:
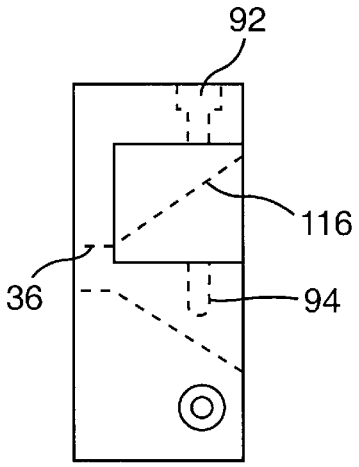
Figure 5C:
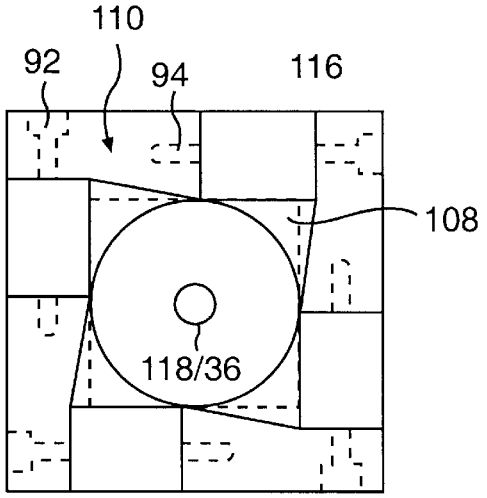
Figure 6A:
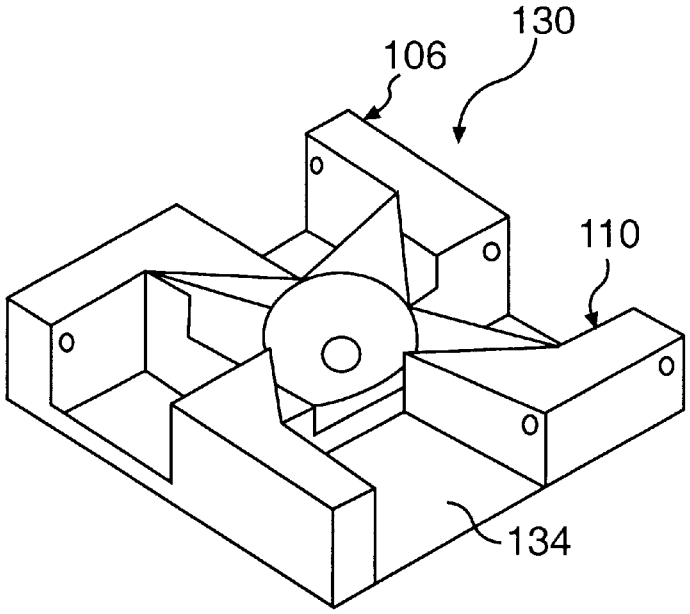
FIG. 6(*a*) is an isometric view of a quick erect shelter hub according to a third embodiment of the present invention.
Figure 6B:
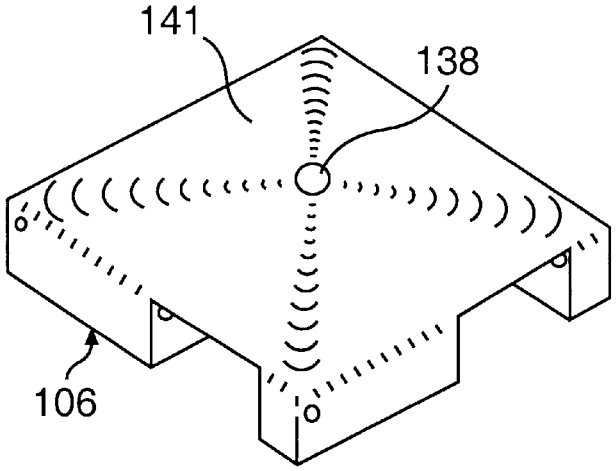
Figure 6C:
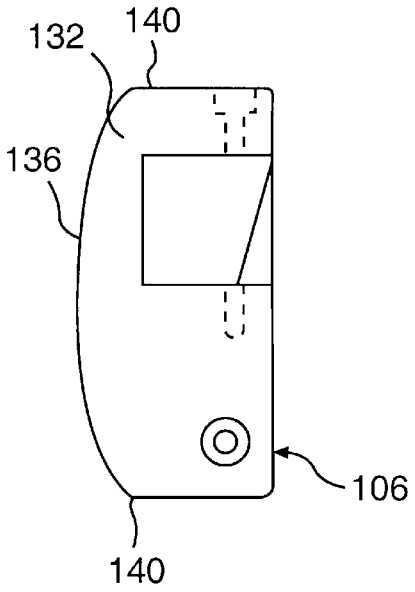
Figure 6D:
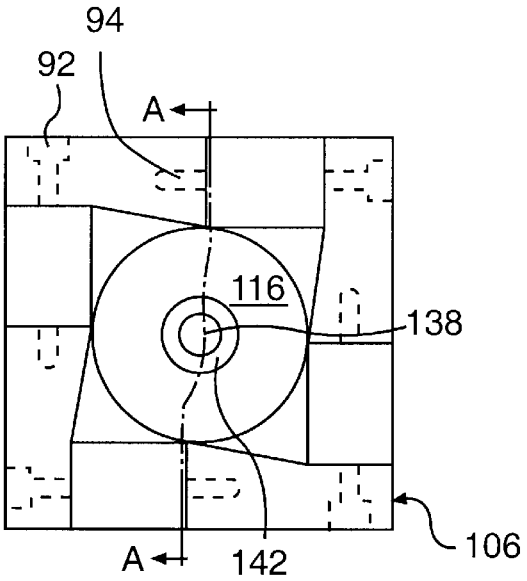
Figure 6E:
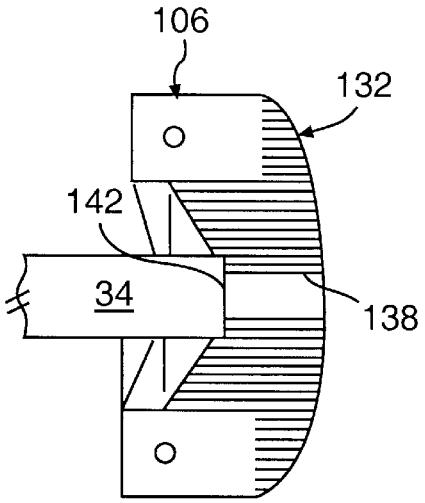
Figure 7A:
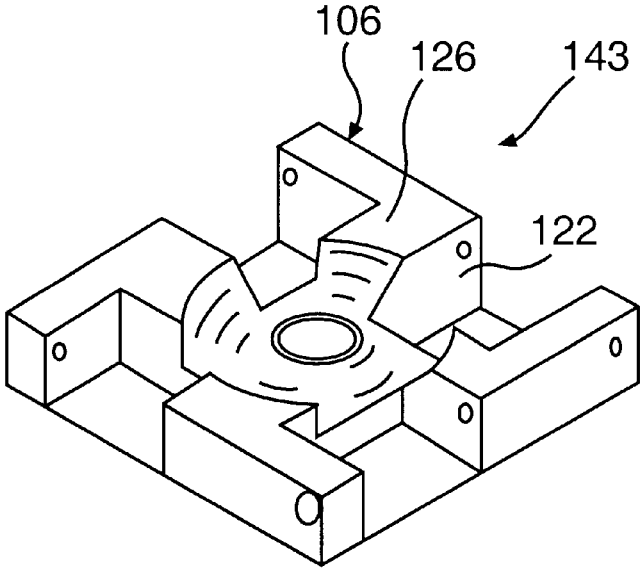
FIG. 7(*a*) is an isometric view of a quick erect shelter hub according to a fourth embodiment of the present invention.
Figure 7B:
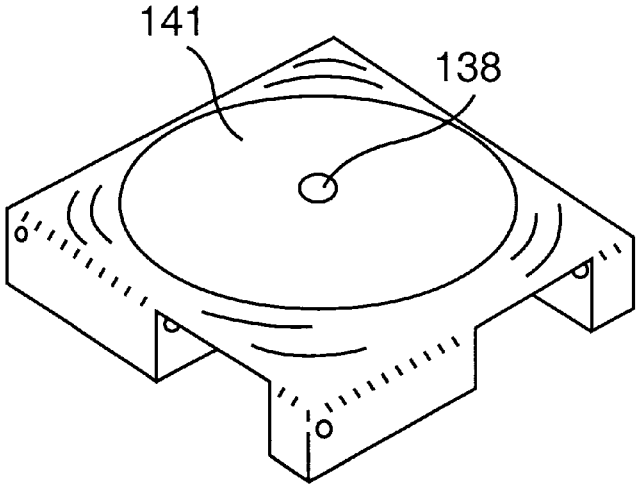
Figure 7C:
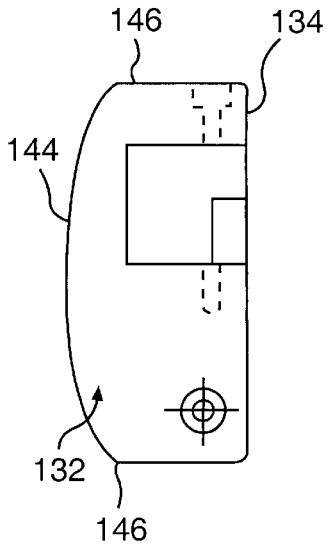
Figure 7D:
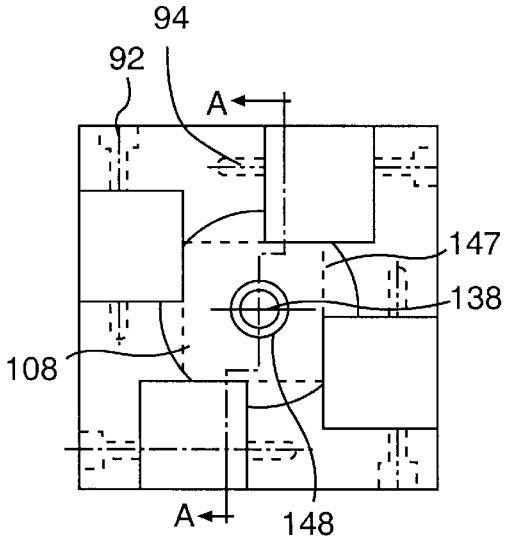
Figure 7E:
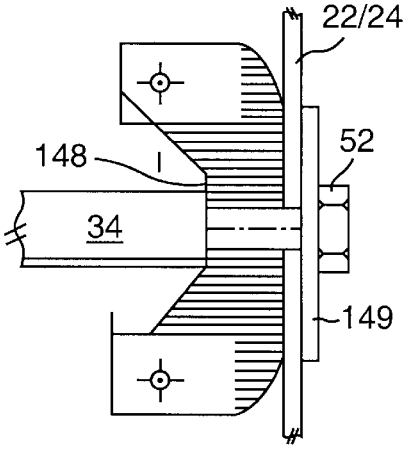
Figure 8A:
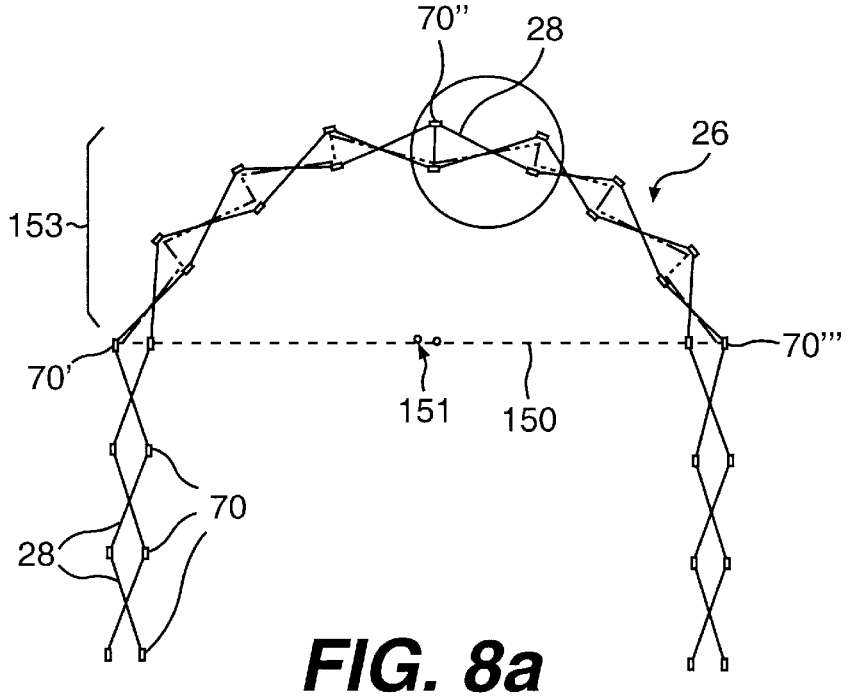
FIG. 8(*a*) is a side view of a quick erect shelter frame assembly according to the present invention.
Figure 8B:
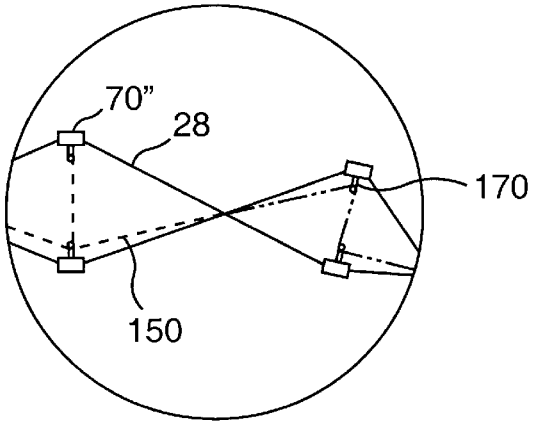
Figure 8C:
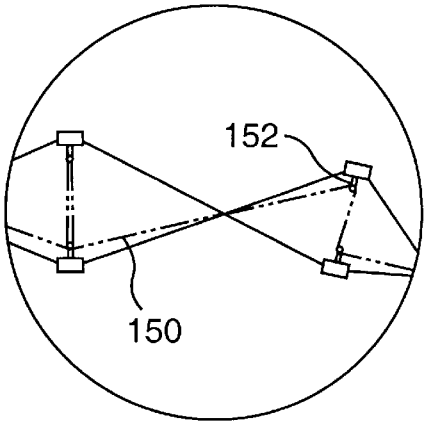
Figure 8D:
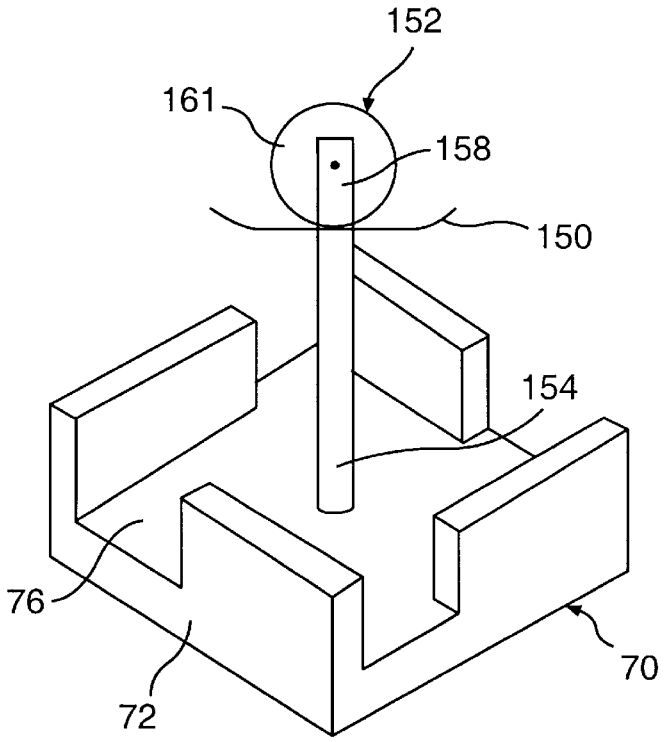
Figure 8E:
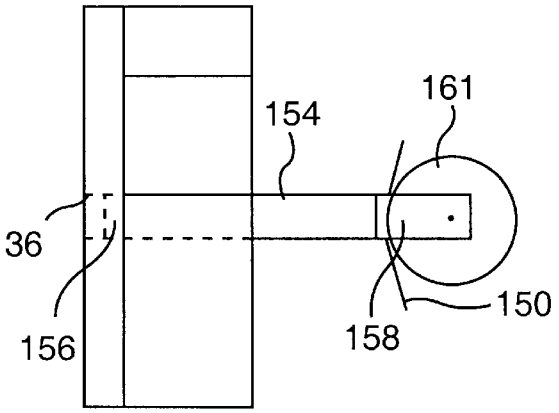
Figure 8F:
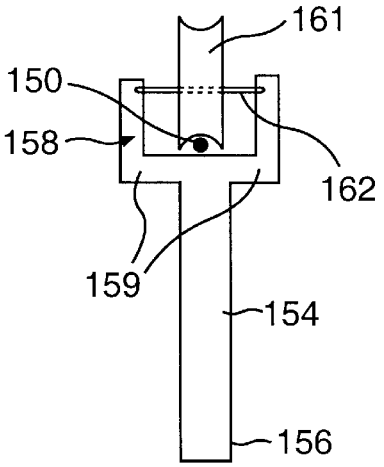

Referring to FIGS. 5(*a*)–5(*c*), the hub 105 is one piece and includes a base portion 72 which is similar to the base portion of the first embodiment, and includes support member 106 which extends from the upper surface 76 of the base portion 72, and is substantially flush with peripheral edges 74 of the base portion 72. The support member 106 includes a center portion 108 from which extend four arms 110 at right angles all in the same rotary direction, each arm 110 forming a rectangular cutout 107 with the adjacent arm.

The center portion 108 has a frustoconical recess 116 formed therein which is concentric with and extends to the hole 36 extending through the base portion 72.

Each arm 110 includes a first portion 120, which is flush with a respective peripheral edge 74, and has a top surface 128, and a hole 92 extending therethrough in a direction perpendicular to a face 129 thereof. Each arm 110 further includes a second portion 122, communicating with the center portion 108, and having a side 123, a top surface 126, and a bore 94 extending in the side 123 thereof in a direction perpendicular to the hole 92 of the first portion 120. The bore 94 of the second portion 122 of each arm 110 is axially aligned with the hole 92 of the first portion 120 of an adjacent arm 110. The top surface 126 of the second portion 122 is bevelled downward from top surface 128 of the first portion of the same arm 110 to the upper edge of the base peripheral of the frustoconical recess 116.

The frustoconical recess 116 has a base diameter substantially the same as the length and width of the center portion 108 and frustum diameter substantially the same as the diameter of the hole 36 formed in the base portion 72. The hub 105 accommodates up to four pivotally connected struts 28, as was shown in the hub 70 of the first embodiment. Furthermore, the quick erect shelter hub 105 of the second embodiment may further include the struts and utility lines shown in the first embodiment. Since in this embodiment the hub 105 has a frustoconical recess 116, it is now possible to easily insert the stabilizing rods 34 between opposing hubs 105. The frustoconical recess 116 also allows one to use a shorter mounting means (e.g., bolt or screw), which reduces the weight of the shelter.

As shown in FIGS. 6(*a*)–6(*c*), the third embodiment of the quick erect shelter hub 130 is one piece and includes a base portion 132, which is preferably rectangular, and a support member 106 extending from the base portion 132. The base portion 132 includes peripheral edges 140, an upper surface 134, a convex lower surface 136, and a center portion 141 having a hole 138 extending therethrough. The convex lower surface 136 of the base portion 132 slopes downward from the center portion 141 toward the peripheral edges 140. The support member 106 of hub 130 is substantially similar to the support member of the second embodiment except that the frustoconical recess 116 includes a ring-shaped shoulder 142 having an inner diameter substantially the same as the diameter of the hole 138 of the base portion 132, and an outer diameter substantially equal to or greater than an outer diameter of a stabilizing rod 34.

Since the base portion 132 includes a convex lower surface 136, the fabric of the exterior canopy 22 (or interior liner 24) can flex around the convex lower surface 136 of the hub 130 without creating undue tension in the fabric; and since the frustoconical recess 116 has a ring-shaped shoulder 142, the stabilizing rod 34 can snugly connect with the hub 130 with very little play, i.e., range of motion, if any. Although base portions having a convex bottom surface is illustrated in connection with the third embodiment, the other embodiments may also include such a feature to provide an accommodating surface for the fabric of the canopy 22 or liner 24.

Referring to FIGS. 7(*a*)–7(*e*), the fourth embodiment of a quick erect shelter hub 143 is also one piece and includes a base portion 132, preferably rectangular, having an upper surface 134, a substantially flat lower surface 144, curved peripheral edges 146 connecting the lower surface 144 to the upper surface 134, a center portion 141, and a hole 138 extending through the center portion 141. The support member 106 of hub 143 has a recess 147 that is substantially hemispherical in configuration, eliminating the beveled top surface of the third embodiment. Furthermore, the base periphery of the hemispherical recess 147 begins at the top surface 126 of the second portion 122 of each arm 106 and includes a base diameter equal to the length and width of the center portion 108. The recess 147 has an annular shoulder 148 with an inner diameter substantially the same as the diameter of the hole 138. As seen in FIGS. 7(*d*) and (*e*), the stabilizing rod 34 abuts against the annular shoulder 148 of the hemispherical recess 147, and the annular shoulder 148 has an outer diameter greater than the diameter of the stabilizing rod 34.

The benefit of having a base portion 132 with a substantially flat lower surface 144, is that when the exterior canopy 22 or interior liner 24 is connected to the hub 143, a flat washer 149 may be used with the bolt 52. The flat washer 149 engages the fabric of the canopy 22 or liner 24 and presses it flush against the flat lower surface 144. Such an arrangement enables the fabric to be held firmly in place without ripping or tearing the fabric.

Further according to the present the invention, a quick erect shelter frame comprises: a plurality of hubs, a plurality of struts pivotally mounted to respective hubs in a lattice formation, a cable mounted extending around the plurality of hubs, and a rotatably mounted means fastened to each hub for guiding the cable.

As herein embodied and referring to FIGS. 8(*a*)–8(*c*) a quick erect shelter frame 26 employs a cable 150 which provides additional support for the shelter frame 26. The frame 26 comprises a plurality of hubs 70 and a plurality of struts 28 pivotally mounted to respective hubs 70. The frame 26 being interconnected such that it includes an arched portion 153, and has a rotatably mounted means, which may be pulley 152, an eyebolt 170, or similar device, fastened to each hub 70 of the arched portion 153 for guiding the cable 150. When pulled taut, the cable 150 may rotate the rotatably mounting means connected to each hub 70 of the arched portion 153 in order to strengthen the frame 26. Specifically, the cable 150 is woven from hub 70' (located at the left side of the arched portion 153) to hub 70" (located at the top of the arched portion 153) and down to hub 70"' (located at the right side of the arched portion 153). The cable 150 is continuously woven throughout the arched portion 153 of the shelter 20 in a zig-zag manner (see FIG. 8(*a*)) and is connected to itself at a position 151.

FIGS. 8(*d*)–8(*e*) show the connection between the rotatably mounted means, in this case a pulley 152, and the one piece hub 70 of the second embodiment, which alternatively could be a hub according to any of the embodiments of the present invention. Specifically, the end 156 of the stem portion 154 of the pulley 152 is connected to a hub 70 at the hole 36. The pulley 152 extends from the upper surface 76 of the base portion 72 of the hub 70 in a direction substantially perpendicular thereto. The cable 150 engages a surface portion of the pulley wheel 161.

FIG. 8(*f*) shows that the pulley 152 includes a pulley wheel 161, a stem portion 154, having an end 156, wherein the stem portion 154 terminates in a buckle portion 158, which is U-shaped but may be any other appropriate shape. The buckle portion 158 has two symmetrically opposed arms 159 into which extends a pivot screw or pin 162 for engaging the pulley wheel 161.

Alternatively, an eyebolt 170 may be connected to each hub 70 of the arched portion 153 of the frame 26, instead of the pulley 152. In an eyebolt arrangement, the cable 150 is fed through the eye of each eyebolt 170 in order to guide the cable 150 throughout the frame 26.

The cable 150 provides a more rigid quick erect shelter than a conventional shelter 20 utilizing stabilizing rods 34, thus allowing the cabled shelter to withstand even greater loads due to wind, snow, etc. Furthermore, by connecting the cable 150 at the position 151, there is provided additional shelter framework which can be used to form a ceiling in the shelter if required. When a ceiling is created utilizing the cable 150 as a ceiling support and the interior liner 24, the ceiling height of the shelter is lowered which allows for reduced heating requirements.

It will be apparent to those skilled in the art that various modifications and variations can be made in the hub and shelter of the present invention and in construction of the hub and shelter without departing from the scope or spirit of the invention. Thus it is intended that the present invention cover the modifications and variations of this invention provided they come within the scope of the appended claims and their equivalents.

What is claimed is:

1. A quick erect shelter frame comprising:

a plurality of hubs, each hub including a base portion having peripheral edges, an upper surface, and a lower surface, and a plurality of support members extending from the upper surface of the base portion substantially flush with a respective peripheral edge, the plurality of support members spaced from one another in noncontacting relationship to form an unobstructed central portion above the upper surface of the base portion and between the support members, each of the plurality of support members having a length less than the length of the respective peripheral edge of the base portion.

2. A quick erect shelter frame comprising:

a plurality of hubs, each hub including a base portion having peripheral edges, an upper surface, and a lower surface, and a plurality of support members extending from the upper surface of the base portion substantially flush with a respective peripheral edge, the plurality of support members spaced from one another in noncontacting relationship to form an unobstructed central portion above the upper surface of the base portion and between the support members, each of the plurality of support members having a top surface, a length less than one peripheral edge of the base portion, a hole extending through a first end of each support member in a direction perpendicular to a face surface thereof, and a bore extending in a side of a second end of each support member in a direction perpendicular to the hole of the first end of the same support member, wherein the hole of each support member is axially aligned with the bore of an adjacent support member.

3. The frame of claim 2 further comprising:

a plurality of struts pivotally mounted to each hub, each strut having ends in communication with ends of other struts of the same hub and at least one utility line disposed in at least two struts connected to the same hub, wherein the at least one utility line extends through the at least two struts and adjacent to the upper surface of the base portion of the same hub.

4. The frame of claim 3 further comprising:

brace portions, each extending from a respective support member and the upper surface of the base portion, wherein each brace portion extends inwardly towards the center of the base portion from the top surface of the support member at an angle.

5. The frame of claim 3, wherein the at least one utility line is one of an electrical line, a gas line, and a water line.

6. A quick erect shelter frame comprising:

a plurality of hubs, each hub including a base portion having peripheral edges, an upper surface, a lower surface, and a center with a hole extending there through in a direction perpendicular to the upper surface, and a plurality of support members extending from the upper surface of the base portion substantially flush with a respective peripheral edge, the plurality of support members spaced from one anther in noncontacting relationship to form an unobstructed central portion above the upper surface of the base portion and between the support members, each of the plurality of support members having a length less than one peripheral edge of the base portion, a hole extending through a first end of each support member in a direction perpendicular to a face surface thereof, and a bore extending in a side of a second end of each support member in a direction perpendicular to the hole of the first end of the same support member, wherein the hole of each support member is axially aligned with the bore of an adjacent support member;

a plurality of struts pivotally mounted to respective hubs in a lattice formation;

a cable extending around each of the plurality of hubs; and a rotatably mounted means fastened to each hub for guiding the cable.

7. The frame of claim 6, wherein the rotatably mounted means is a pulley comprising:

a pulley wheel, and a stem portion having an end and terminating in a U-shaped buckle portion having two symmetrically opposed arms, and a pivot pin extending into each arm of the buckle portion for engaging the pulley wheel, wherein the end of the stem portion connects to the hole of the base portion of a respective hub, the pulley extends from the upper surface of the base portion of the hub in a direction substantially perpendicular thereto, and the cable engages a surface portion of the pulley wheel.

8. A quick erect shelter frame comprising:

a plurality of hubs, each hub being one piece and including a base portion having peripheral edges, an upper surface, a lower surface, and a center with a hole extending therethrough in a direction perpendicular to the upper surface, and a support member extending from the upper surface of the base portion substantially flush with the peripheral edges of the base portion, the support member having a center portion communicating with ends of four arms extended at right angles all in the same rotary direction, the center portion having a top surface, a hole extending therethrough which communicates with the hole of the base portion, and a frustoconical recess formed in the top surface which is concentric with the hole extending through the center portion, each arm forming an open rectangular cutout portion in the support member and having a first portion which is flush with a respective peripheral edge and has a top surface and a hole extending therethrough in a direction perpendicular to a face thereof, and a second portion communicating with the center portion and having a side, a top surface, and a bore extending in the side thereof in a direction perpendicular to the hole of the first portion, wherein the hole of each arm is axially aligned with the bore of an adjacent arm.

9. The frame of claim 8 further comprising:

a plurality of struts pivotally mounted to each hub, each strut having ends in communication with ends of other struts of the same hub.

10. The frame of claim 9 further comprising:

stabilizing rods connected between opposing hubs, and wherein the lower surface of the base portion is convex and slopes downward from the center thereof toward the peripheral edges of the base portion, and the frustoconical recess includes a ring-shaped shoulder having an inner diameter substantially the same as the diameter of the hole formed in the base portion and an outer diameter substantially equal to or greater than an outer diameter of one of the stabilizing rods.

11. The frame of claim 9 further comprising:

a cable extending around each of the plurality of hubs; and a rotatably mounted means fastened to each hub for guiding the cable.

12. The frame of claim 11, wherein the rotatably mounted means is a pulley comprising:

a pulley wheel, and a stem portion having an end and terminating in a U-shaped buckle portion having two symmetrically opposed arms, and a pivot pin extending into each arm of the buckle portion for engaging the pulley wheel, wherein the end of the stem portion connects to the hole of the base portion of a respective hub, the pulley extends from the upper surface of the base portion of the respective hub in a direction substantially perpendicular thereto, and the cable engages a surface portion of the pulley wheel.

13. A quick erect shelter frame comprising:

stabilizing rods connected between opposing hubs; and a plurality of hubs, each hub being one piece and including a base portion having curved peripheral edges, an upper surface, a substantially flat lower surface, and a center with a hole extending therethrough in a direction perpendicular to the upper surface, and a support member extending from the upper surface of the base portion substantially flush with the curved peripheral edges of the base portion, the support member having a center portion communicating with ends of four arms extended at right angles all in the same rotary direction, the center portion having a top surface, a hole extending therethrough which communicates with the hole of the base portion, each arm forming an open rectangular cutout portion in the support member and having a first portion which is flush with a respective peripheral edge and has a top surface and a hole extending therethrough in a direction perpendicular to a face thereof, and a second portion communicating with the center portion and having a side, a top surface, and a bore extending in the side thereof in a direction perpendicular to the hole of the first portion, wherein the hole of each arm is axially aligned with the bore of an adjacent arm, the support member further having hemispherical recess having a base periphery which begins at the top surface of the second portion of each arm and includes a base diameter equal to the length and width of the center portion, the recess having an annular shoulder with an inner diameter substantially the same as the diameter of the hole and an outer diameter greater than the diameter of the stabilizing rod.

14. The frame of claim 13 further comprising:

a plurality of struts pivotally mounted to each hub, each strut having ends in communication with ends of other struts of the same hub.

* * * * *

UNITED STATES PATENT AND TRADEMARK OFFICE

CERTIFICATE OF CORRECTION

PATENT NO. : 5,943,837

DATED : August 31, 1999

INVENTOR(S) : Richard ESSER et al.

It is certified that error appears in the above-identified patent and that said Letters Patent is hereby corrected as shown below:

Claim 6, Col. 9, lines 27-28, change "there through" to --therethrough--.

Claim 6, Col. 9, line 33, change "anther" to --another--.

Signed and Sealed this
First Day of February, 2000

*Attest:*

*Attesting Officer*

Q. TODD DICKINSON

*Acting Commissioner of Patents and Trademarks*